US010274243B2

(12) United States Patent
Yoo et al.

(10) Patent No.: US 10,274,243 B2
(45) Date of Patent: Apr. 30, 2019

(54) REFRIGERATOR

(71) Applicant: LG ELECTRONICS INC., Seoul (KR)

(72) Inventors: Myung Keun Yoo, Seoul (KR); Ho Hyun Son, Seoul (KR); Hyun Sook Song, Seoul (KR)

(73) Assignee: LG Electronics Inc., Seoul (KR)

( * ) Notice: Subject to any disclaimer, the term of this patent is extended or adjusted under 35 U.S.C. 154(b) by 340 days.

(21) Appl. No.: 14/772,932

(22) PCT Filed: Mar. 5, 2013

(86) PCT No.: PCT/KR2013/001745
§ 371 (c)(1),
(2) Date: Sep. 17, 2015

(87) PCT Pub. No.: WO2014/136997
PCT Pub. Date: Sep. 12, 2014

(65) Prior Publication Data
US 2018/0231297 A1 Aug. 16, 2018

(51) Int. Cl.
*F25D 17/06* (2006.01)
*F04D 29/44* (2006.01)
*F04D 29/62* (2006.01)

(52) U.S. Cl.
CPC ..... *F25D 17/067* (2013.01); *F04D 29/441* (2013.01); *F04D 29/626* (2013.01);
(Continued)

(58) Field of Classification Search
CPC ..... F25D 17/067; F25D 17/062; F25D 2317/067; F25D 2317/0683;
(Continued)

(56) References Cited

U.S. PATENT DOCUMENTS 5,704,224 A * 1/1998 Choi ..... F25D 17/065 62/407
6,170,275 B1 1/2001 Ueno et al.
(Continued)

FOREIGN PATENT DOCUMENTS

CN 1177189 11/2004
JP 2000-274912 A 10/2000
(Continued)

OTHER PUBLICATIONS

Extended European Search Report issued in European Application No. 13877259.5 dated Oct. 7, 2016, 7 pages.
(Continued)

*Primary Examiner* — Emmanuel Duke
(74) *Attorney, Agent, or Firm* — Fish & Richardson P.C.

(57) ABSTRACT

A refrigerator of the present invention comprises: an evaporator; a shroud provided with a suction hole for sucking the air heat-exchanged with the evaporator; a fan motor unit provided to the shroud; a discharge panel provided with a discharge hole for discharging, to a storage chamber, the air flowing by the fan motor unit; and a door for opening and closing the storage chamber, wherein the shroud is provided with a fan motor unit provision part at the surface facing the discharge panel so as to provide the fan motor unit thereto, and the fan motor unit enables the air to flow at a position between the shroud and the discharge panel so as to minimize the passage resistance of the air, which is sucked through the suction hole, and minimize noise.

18 Claims, 4 Drawing Sheets

(52) U.S. Cl.
CPC ..... *F25D 17/062* (2013.01); *F25D 2317/063* (2013.01); *F25D 2317/067* (2013.01); *F25D 2317/0681* (2013.01); *F25D 2317/0683* (2013.01); *F25D 2500/02* (2013.01)

(58) Field of Classification Search
CPC ..... F25D 2317/0681; F25D 2317/063; F25D 2500/02; F25D 17/06; F25D 17/065; F25D 17/045; F04D 29/441; F04D 29/384
See application file for complete search history.

(56) References Cited

U.S. PATENT DOCUMENTS 6,948,332 B2 * 9/2005 Lee, II ..... F04D 29/34 62/407
2003/0024264 A1 * 2/2003 Jung ..... F04D 29/384 62/426
2007/0266718 A1 * 11/2007 Lee ..... F25D 17/065 62/187
2007/0266727 A1 * 11/2007 Bae ..... F25D 17/065 62/419
2008/0006043 A1 * 1/2008 Lee ..... F25D 17/06 62/186
2008/0256964 A1 10/2008 Lee

FOREIGN PATENT DOCUMENTS

JP 2002-267330 9/2002
JP 2003-314500 A 11/2003
JP 2003314500 A * 11/2003
JP 2005-291577 A 10/2005
JP 2007-071496 A 3/2007
KR 10-2008-0089106 A 10/2008
WO WO 2008/120927 A2 10/2008

OTHER PUBLICATIONS

Office Action issued in Chinese Application No. 201380076000.3 dated Jul. 4, 2016, 13 pages (with English translation).
International Search Report dated Jul. 9, 2013 for Application No. PCT/KR2013/001745, 4 pages.

* cited by examiner

REFRIGERATOR

CROSS REFERENCE TO RELATED APPLICATIONS

This application is a U.S. National Phase Application under 35 U.S.C. § 371 of International Application PCT/KR2013/001745, filed on Mar. 5, 2013, the entire contents of which is hereby incorporated by reference in their entireties.

TECHNICAL FIELD

The present invention relates to a refrigerator and, more particularly, to a refrigerator having a fan motor unit to blow air, that has been cooled by an evaporator, into a storage compartment.

BACKGROUND ART

Generally, a refrigerator is an appliance that cools a storage compartment such as, for example, a refrigerating compartment and a freezing compartment using a refrigeration cycle device consisting of a compressor, a condenser, an expander, and an evaporator.

The refrigerator may be provided with a blowing mechanism, which moves air from, for example, the refrigerating compartment and the freezing compartment to the evaporator, and thereafter blows the air to, for example, the refrigerating compartment and the freezing compartment.

The blowing mechanism may include a motor having a rotating shaft, and a fan installed to the rotating shaft, and the fan may be a centrifugal fan or an axial flow fan.

The refrigerator may include a shroud (or an orifice) provided with a suction hole, through which the air cooled by the evaporator is suctioned, and a discharge panel (or a discharge grill) provided with a discharge hole, through which the air is discharged to the freezing compartment. The fan may be located between the shroud and the discharge panel, and the motor may be located between the evaporator and the suction hole in the direction in which the air flows.

RELATED ART DOCUMENT

Patent Document 001 KR 10-0584269 B1 (26.05.2006)

DISCLOSURE

Technical Problem

The refrigerator according to the related art has problems of high flow-path resistance and high noise because the motor is located between the evaporator and the suction hole in the direction in which the air flows.

The present invention is devised to solve the problems of the related art described above, and an object of the present invention is to provide a refrigerator which has minimized flow-path resistance and noise.

Technical Solution

To solve the above-described problem, according to the present invention, a refrigerator includes an evaporator, a shroud formed with a suction hole for suction of air having undergone heat exchange with the evaporator, a fan motor unit installed to the shroud, a discharge panel formed with a discharge hole for discharge of the air, blown by the fan motor unit, to a storage compartment, and a door configured to open or close the storage compartment, wherein the shroud is formed, on a surface thereof facing the discharge panel, with a fan motor unit mount for installation of the fan motor unit, and wherein the fan motor unit is located at a position between the shroud and the discharge panel so as to flow the air.

At least one of the shroud and the discharge panel may be formed with a housing portion, the housing portion being configured to guide the air having passed through the suction hole, and the fan motor unit mount may be formed at at least one position between the suction hole and the housing portion.

The fan motor unit may include a motor bracket fastened to the fan motor unit mount, a motor installed to the motor bracket so as to be located between the shroud and the discharge panel, the motor having a rotating shaft configured to protrude toward the suction hole, and a fan installed to the rotating shaft, the fan being rotated between the shroud and the discharge panel.

The fan may be a turbo fan configured to suction air from the rear side and to blow the air in a radial direction.

The fan motor unit mount may protrude from the shroud to the discharge panel, and may be spaced apart from a periphery of the fan in a radial direction of the fan.

The fan motor unit mount may include a plurality of bosses protruding from the shroud so as to be spaced apart from the shroud, and a virtual circle connecting the bosses to one another may be larger than the fan.

The shroud may have an opening formed in one of a left plate and a right plate, the shroud may have a rear plate formed with a flow path guide to guide air to the opening, the flow path guide protruding toward the discharge panel, and the fan motor unit mount may be formed at at least one position between the suction hole and the flow path guide.

The fan motor unit mount may include a plurality of bosses protruding from the shroud so as to be spaced apart from the shroud, and a center axis of a virtual circle connecting the bosses to one another may coincide with a center axis of the suction hole.

The fan motor unit mount may have a tip end spaced apart from a rear surface of the discharge panel in a front-and-rear direction.

The shroud may include a rear plate formed with the suction hole, and a left plate, a right plate, and an upper plate formed at the rear plate, and the fan motor unit mount may include a plurality of bosses formed at a front surface of the rear plate so as to protrude toward the discharge panel.

The shroud may be provided at an upper portion with a receiving portion for reception of the fan motor unit, the receiving portion being stepped to protrude rearward, and the fan motor unit mount may be formed at the receiving portion.

The shroud may include an evaporator flow path guide portion located at the front side of the evaporator, the evaporator flow path guide being configured to guide air flowing from the storage compartment to the evaporator.

According to the present invention, a refrigerator includes a main body defining a freezing compartment, a refrigerating compartment, and a heat exchange chamber, an evaporator installed in the heat exchange chamber, a freezing compartment door configured to open or close the freezing compartment, a refrigerating compartment door configured to open or close the refrigerating compartment, a shroud formed with a suction hole for suction of air having undergone heat exchange with the evaporator and an opening, a discharge panel formed with a discharge hole for discharge of cold air to the freezing compartment, a fan motor unit installed to the shroud, the fan motor unit being configured to suction air into the suction hole and to discharge the air through the opening and the discharge hole, a cold air discharge duct configured to communicate the opening and the refrigerating compartment with each other, and a cold air suction duct configured to communicate the refrigerating compartment and the heat exchange chamber with each other, wherein the shroud is formed, on a surface thereof facing the discharge panel, with a fan motor unit mount for installation of the fan motor unit, and wherein the fan motor unit is located at a position between the shroud and the discharge panel so as to flow the air.

At least one of the shroud and the discharge panel may be configured to separate the freezing compartment and the heat exchange chamber from each other.

At least one of the shroud and the discharge panel may be configured to guide, air, introduced into the heat exchange chamber, to the evaporator.

Advantageous Effects

The present invention may advantageously reduce the number of revolutions per minute of a fan while maintaining the same flow rate thanks to the low flow-path resistance of air encountered by air suctioned into a suction hole of a shroud, and reduce power consumption and noise.

In addition, the present invention may advantageously make it possible to manufacture a slim refrigerator, or to maximize the volume of a storage compartment.

In addition, coincidence of the center axis of the fan and the center axis of the suction hole may be easily accomplished, and the number of additional operations for the maintenance of the concentric arrangement may be minimized.

BEST MODE

Hereinafter, an embodiment of the present invention will be described in detail with reference to the accompanying drawings.

Figure 1:
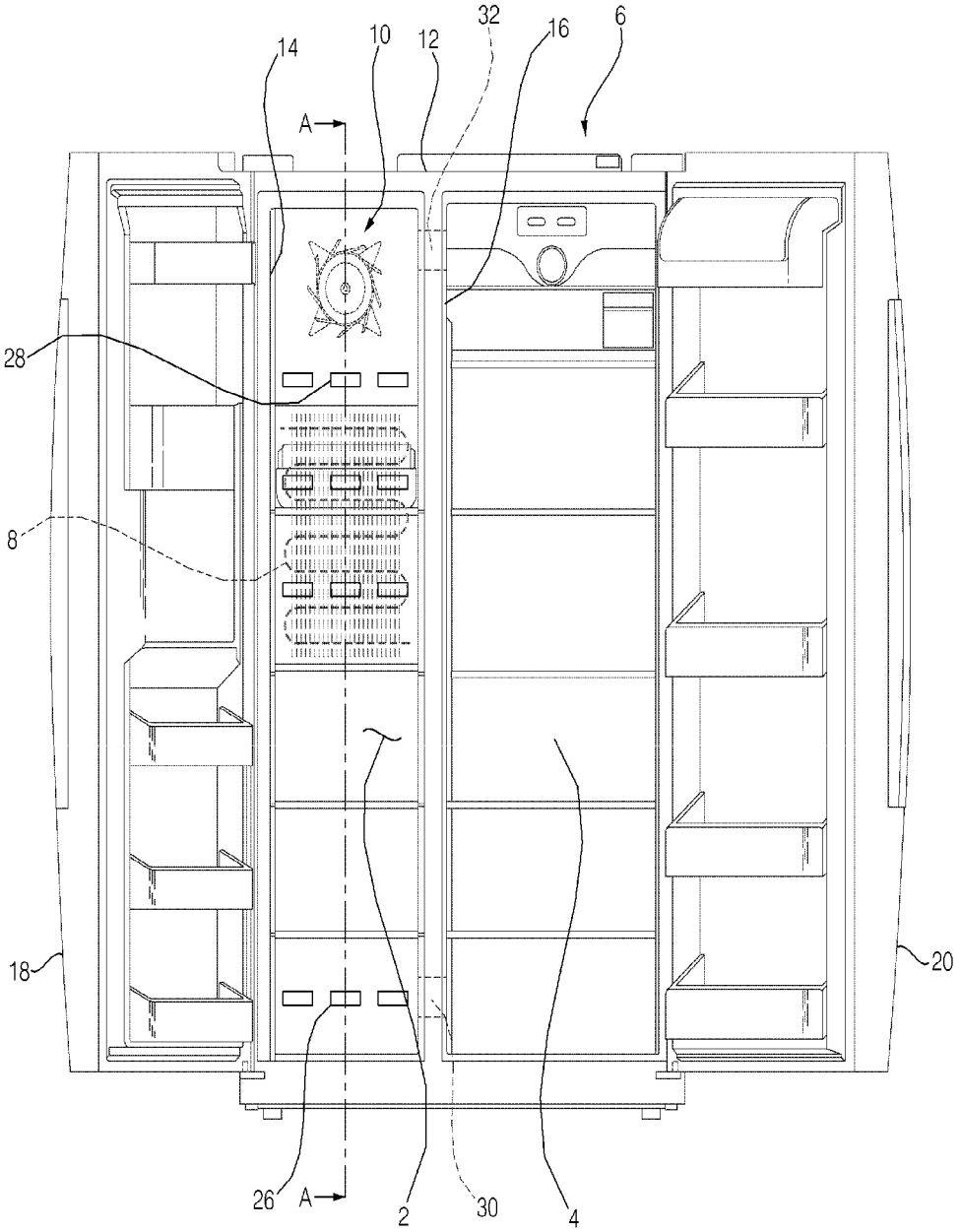
FIG. 1 is a front view illustrating the inside of a refrigerator according to one embodiment of the present invention.
Figure 2:
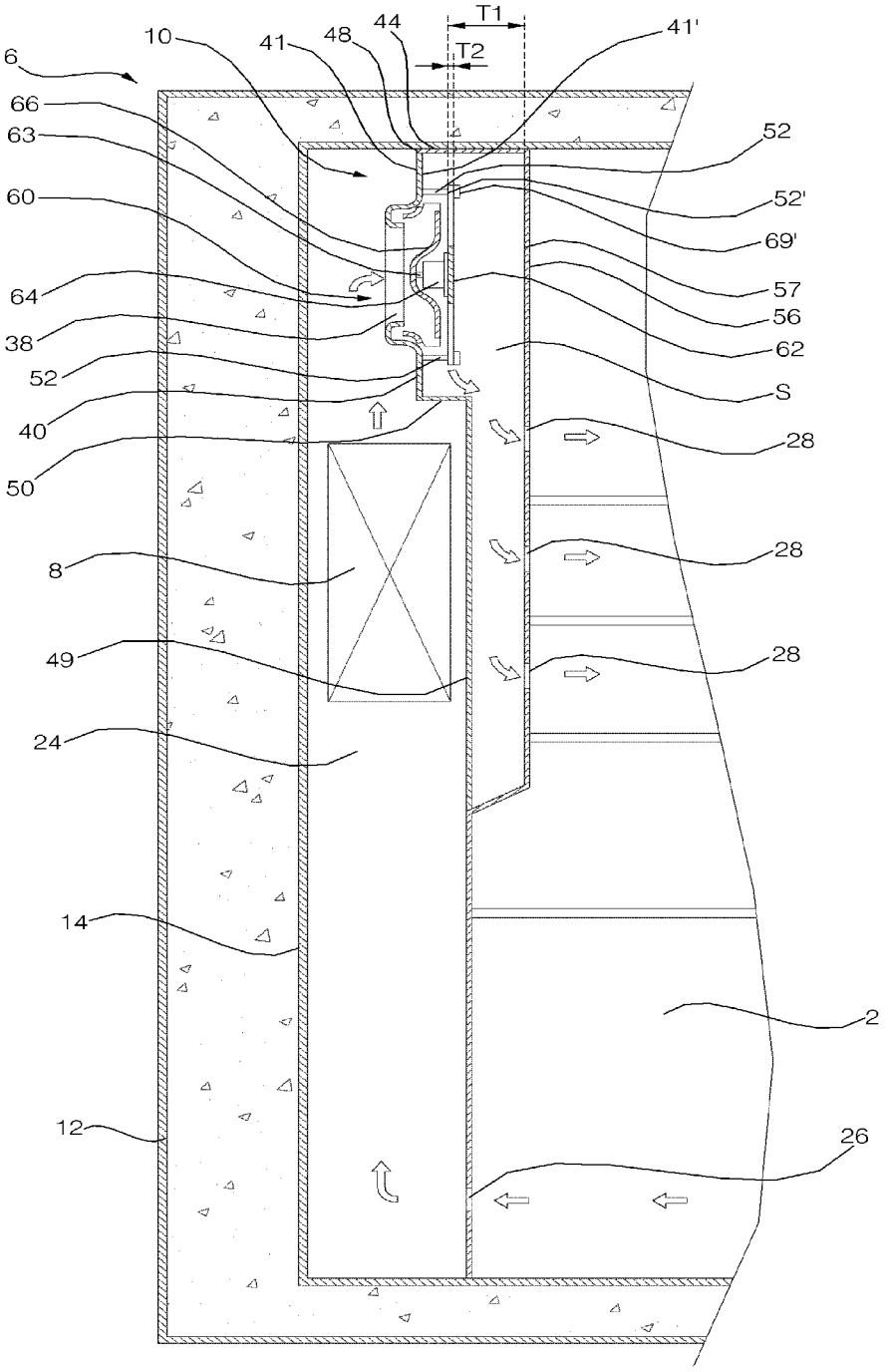
FIG. 2 is a sectional view taken along line A-A illustrated in FIG. 1.
Figure 3:
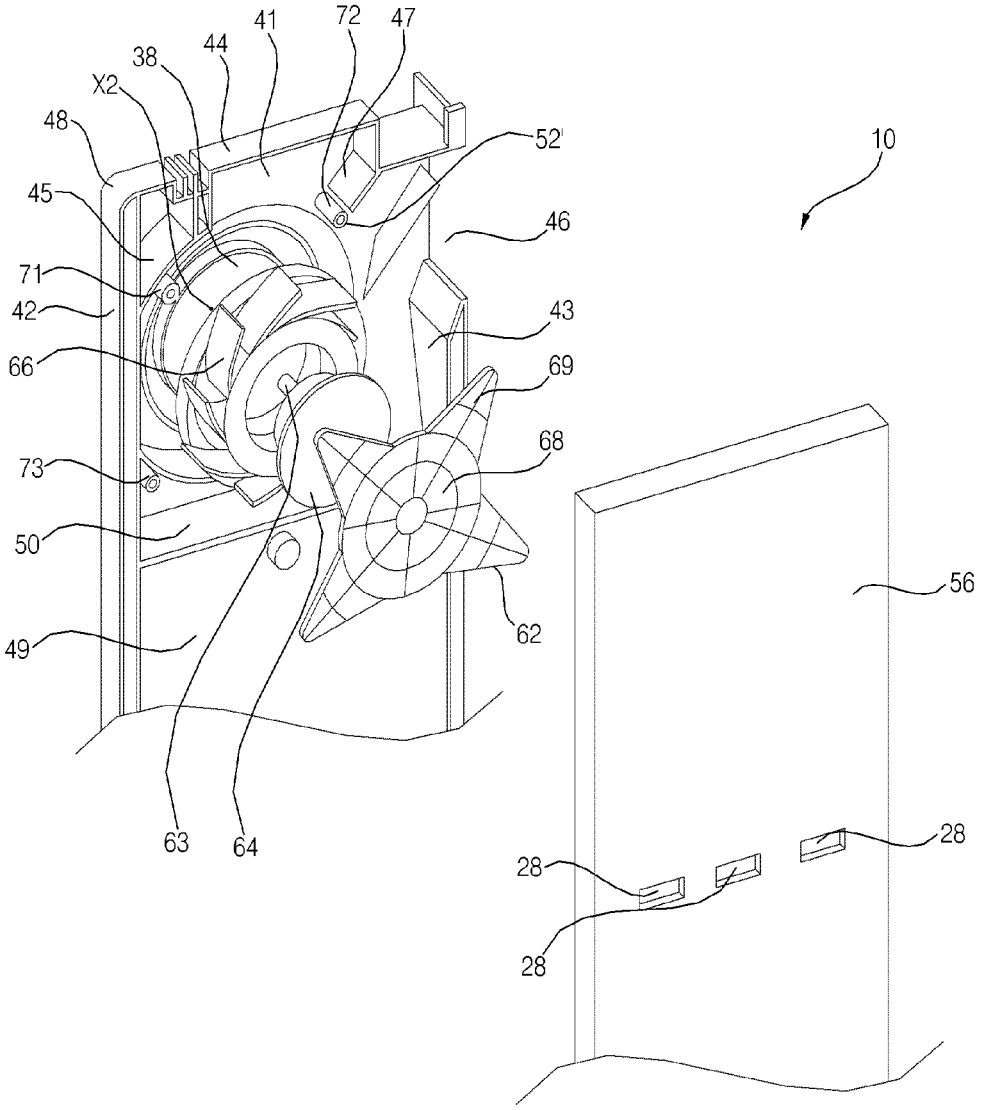
FIG. 3 is an exploded perspective view illustrating major parts of the refrigerator according to one embodiment of the present invention.
Figure 4:
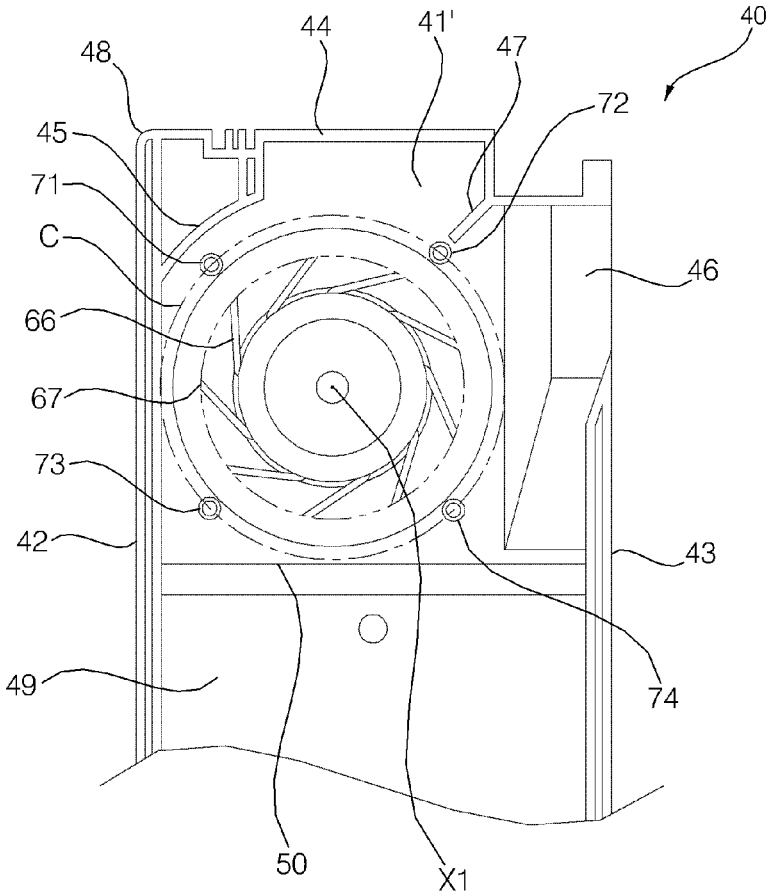
FIG. 4 is a front view illustrating a shroud and a fan of the refrigerator according to one embodiment of the present invention.

FIG. 1 is a front view illustrating the inside of a refrigerator according to one embodiment of the present invention, FIG. 2 is a sectional view taken along line A-A illustrated in FIG. 1, FIG. 3 is an exploded perspective view illustrating major parts of the refrigerator according to one embodiment of the present invention, and FIG. 4 is a front view illustrating a shroud and a fan of the refrigerator according to one embodiment of the present invention.

The refrigerator of the present embodiment may include a main body 6 defining storage compartments 2 and 4; an evaporator 8 to cool the storage compartments 2 and 4; and a fan assembly 10 to circulate air inside the storage compartments 2 and 4 through the evaporator 8 and the storage compartments 2 and 4.

The main body 6 may define a single storage compartment, or a plurality of storage compartments therein. In the case where multiple storage compartments are provided, the respective storage compartments may be maintained at different temperature ranges. In the case where multiple storage compartments are provided, for example, two, three, or four storage compartments may be provided, although the embodiment is not limited to the number of storage compartments. Any one of the storage compartments may be a freezing compartment 2, and the other one of the storage compartments may be a refrigerating compartment 4. Hereinafter, the case where the main body 6 defines the freezing compartment 2 and the refrigerating compartment 4 therein will be described by way of example.

A refrigeration cycle device including the evaporator 8 may be installed in the main body 6. The refrigeration cycle device may further include a compressor (not illustrated) to compress a refrigerant, a condenser (not illustrated) to condense the refrigerant compressed in the compressor, and an expander (not illustrated) to expand the refrigerant condensed in the condenser, and the compressor, the condenser, and the expander may be installed, along with the evaporator 8, in the main body 6. When the refrigerant is compressed in the compressor, the compressed refrigerant may flow to the condenser, the refrigerant having passed through the condenser may flow to the expander, the refrigerant having passed through the expander may flow to the evaporator, and the refrigerant having passed through the evaporator may flow to the compressor.

The main body 6 may include an outer case 12 defining the external appearance, and inner cases 14 and 16 located inside the outer case 12, the inner cases defining the storage compartments 2 and 4 therein.

Each of the inner cases 14 and 16 may be formed into a box shape having one open side, and, for example, food may be introduced or retrieved through the open side. The inner case may be formed in a manner such that one member forms one inner case, or such that a plurality of members is coupled to form one inner case. The inner cases 14 and 16 may include a first inner case 14 defining the freezing compartment 2 therein and a second inner case 16 defining the refrigerating compartment 4 therein.

The refrigerator may include doors to open or close the storage compartments. The doors may include a freezing compartment door 18 to open or close the freezing compartment 2. The doors may include a refrigerating compartment door 20 to open or close the refrigerating compartment 4. One freezing compartment door, or two or more freezing compartment doors 18 may be provided to open or close the freezing compartment 2. One refrigerating compartment door, or two or more refrigerating compartment doors 20 may be provided to open or close the refrigerating compartment 4.

The evaporator 8 serves to perform heat exchange between the air inside the storage compartments 2 and 4 and the refrigerant. The refrigerant passing through the evaporator 8 may be evaporated via heat exchange with the air, and the air may be cooled via heat exchange with the refrigerant. The refrigerator may be provided with a plurality of evaporators. Any one of the evaporators may serve to cool the freezing compartment 2, and the other one of the evaporators may serve to cool the refrigerating compartment 4. The refrigerator may be configured such that one evaporator serves to cool both the freezing compartment 2 and the refrigerating compartment 4. Hereinafter, the case where one evaporator 8 cools both the freezing compartment 2 and the refrigerating compartment 4 will be described by way of example. The evaporator 8 may perform heat exchange between the refrigerant and the air inside the freezing compartment 2 and the air inside the refrigerating compartment 4. In the case where one evaporator 8 is installed, the evaporator may be installed closer to the freezing compartment 2 than to the refrigerating compartment 4.

A heat exchange chamber 24 in which the evaporator 8 is installed may be formed in the main body 6. The heat exchange chamber 24 may communicate with the storage compartments 2 and 4. The heat exchange chamber 24 may communicate with the freezing compartment 2, or may communicate with both the freezing compartment 2 and the refrigerating compartment 4.

The heat exchange chamber 24 may be formed outside the inner cases 14 and 16, and may communicate with at least one of the inner cases 14 and 16.

The heat exchange chamber 24 may be formed inside at least one of the inner cases 14 and 16. The main body 6 may be provided with a partition member, which is installed inside at least one of the inner cases 14 and 16. The partition member may be installed inside one of the inner cases 14 and 16. Hereinafter, the case where the partition member is installed inside one of the inner cases 14 and 16 will be described by way of example.

In the case where the partition member is installed inside the first inner case 14, the inside of the first inner case 14 of the main body 6 may be divided into the freezing compartment 2 and the heat exchange chamber 24. In this case, the partition member may be provided with suction holes 26, through which the air inside the storage compartment, i.e. the freezing compartment 2 may be suctioned into the heat exchange chamber 24, and may also be provided with discharge holes 28, through which the air cooled by the evaporator 8 within the heat exchange chamber 24 may be discharged to the storage compartment, i.e. the freezing compartment 2. In the case where the partition member is installed inside the first inner case 14, the evaporator 8 may be located between the first inner case 14 and the partition member. In the case where the partition member is installed inside the first inner case 14, the main body 6 may be provided with a cold air suction duct 30 and a cold air discharge duct 32 for communication between the inside of the first inner case 14 and the inside of the second inner case 12. The cold air suction duct 30 may enable one of the heat exchange chamber 24 and the freezing compartment 2 to communicate with the refrigerating compartment 4. The cold air discharge duct 32 may enable the fan assembly 10 to communicate with the refrigerating compartment 4. The air cooled by the evaporator 8 may be suctioned from the heat exchange chamber 24 to the fan assembly 10, and may thereafter be discharged to the freezing compartment 2 through the discharge holes 28. Then, after flowing inside the freezing compartment 2, the air may be suctioned into the heat exchange chamber 24 through the suction holes 26 so as to again be cooled by the evaporator 8. The air cooled by the evaporator 8 may be suctioned from the heat exchange chamber 24 to the fan assembly 10, and may thereafter be discharged to the refrigerating compartment 4 through the discharge duct 32. Then, after flowing inside the refrigerating compartment 4, the air may be suctioned into the heat exchange chamber 24 through the cold air suction duct 30 so as to again be cooled by the evaporator 8.

In the case where the partition member is installed inside the second inner case 16, the inside of the second inner case 16 of the main body 6 may be divided into the refrigerating compartment 4 and the heat exchange chamber 24. In this case, the partition member may be provided with the suction holes 26, through which the air inside the storage compartment, i.e. the refrigerating compartment 4 may be suctioned into the heat exchange chamber 24, and may also be provided with the discharge holes 28, through which the air cooled by the evaporator 8 within the heat exchange chamber 24 may be discharged to the storage compartment, i.e. the refrigerating compartment 4. In the case where the partition member is installed inside the second inner case 16, the evaporator 8 may be located between the second inner case 16 and the partition member. In the case where the partition member is installed inside the second inner case 16, the main body 6 may be provided with the cold air suction duct 30 and the cold air discharge duct 32 for communication between the inside of the first inner case 14 and the inside of the second inner case 12. The cold air suction duct 30 may communicate the heat exchange chamber 24 with the freezing compartment 2. The cold air discharge duct 32 may communicate the fan assembly 10 with the freezing compartment 4. The air cooled by the evaporator 8 may be suctioned from the heat exchange chamber 24 to the fan assembly 10, and thereafter be discharged to the refrigerating compartment 4 through the discharge holes 28. Then, after flowing inside the refrigerating compartment 4, the air may be suctioned into the heat exchange chamber 24 through the suction holes 26 so as to again be cooled by the evaporator 8. The air cooled by the evaporator 8 may be suctioned from the heat exchange chamber 24 to the fan assembly 10, and thereafter be discharged to the freezing compartment 2 through the discharge duct 32. Then, after flowing inside the freezing compartment 2, the air may be suctioned into the heat exchange chamber 24 through the cold air suction duct 30. Hereinafter, the case where the partition member is installed inside the first inner case 14 will be described by way of example.

The partition member and the fan assembly 10 may be separately installed in the main body 6. Alternatively, instead of the partition member being installed in the main body 6 separately from the fan assembly 10, the fan assembly 10 may function as the partition member. In the case where the fan assembly 10 functions as the partition member, the number of components may be minimized, and a compact configuration may be realized. Hereinafter, the case where the fan assembly 10 functions as the partition member will be described by way of example.

In the refrigerator, the fan assembly 10 alone may function as the partition member. In this case, the air inside the freezing compartment 2 may be suctioned into the heat exchange chamber 24 through the fan assembly 10, and after being cooled by the evaporator 8, the air may again be discharged to the freezing compartment 2 through the fan assembly 10. That is, the fan assembly 10 may function as both a suction panel and a discharge panel.

In the refrigerator, the fan assembly 10 may constitute a portion of the partition member, and a separate suction panel (not illustrated) may constitute the remaining portion of the partition member. In this case, the suction panel may be installed under the fan assembly 10, and the air inside the freezing compartment 2 may be suctioned into the heat exchange chamber 24 through the suction panel. Then, after being cooled by the evaporator 8, the air may again be discharged to the freezing compartment 2 through the fan assembly 10. That is, the fan assembly 10 may function as the discharge panel.

Hereinafter, the case where the fan assembly 10 alone functions as the partition member will be described by way of example.

The fan assembly 10 may include a shroud 40 formed with a suction hole 38, through which the air having undergone heat exchange with the evaporator 8 is suctioned, a discharge panel 56 formed with the discharge holes 28, through which the air is discharged to the storage compartment 2, and a fan motor unit 60 installed to the shroud 40.

At least one of the shroud 40 and the discharge panel 56 may separate the freezing compartment 2 from the heat exchange chamber 24. At least one of the shroud 40 and the discharge panel 56 may guide the air, introduced into the heat exchange chamber 24, to the evaporator 8.

The fan assembly 10 may be formed with the suction holes 26, through which the air inside the storage compartment 2 is suctioned into the heat exchange chamber 24. Hereinafter, the suction holes 26, through which the air inside the storage compartment 2 is suctioned into the heat exchange chamber 24, will be called heat exchange chamber suction holes 26 to distinguish it from the suction hole 38, through which the air having undergone heat exchange with the evaporator 8 is suctioned. The heat exchange chamber suction holes 26 may be formed in the lower portion of the fan assembly 10. The heat exchange chamber suction holes 26 may be formed in at least one of the shroud 40 and the discharge panel 56. In the case where the lower portion of the shroud 40 constitutes the rear surface of the freezing compartment 2 of the refrigerator, the heat exchange chamber suction holes 26 may be formed in the lower portion of the shroud 40. In the case where the lower portion of the discharge panel 56 constitutes the rear surface of the freezing compartment 2 of the refrigerator, the heat exchange chamber suction holes 26 may be formed in the lower portion of the discharge panel 56. When each of the lower portion of the shroud 40 and the lower portion of the discharge panel 56 is located so as to overlap the lower portion of the first inner case 14 in the front-and-rear direction, the heat exchange chamber suction holes 26 of the fan assembly 10 may be formed in each of the lower portion of the shroud 40 and the lower portion of the discharge panel 56 such that the heat exchange chamber 24 communicates with the freezing compartment 2.

In the refrigerator, the air cooled by the evaporator 8 may be suctioned into the fan motor unit 50 through the suction hole 38, the air blown from the fan motor unit 50 may be discharged to the storage compartment 2 through the discharge holes 28, and the air discharged to the storage compartment 2 may be suctioned to the evaporator 8 through the heat exchange chamber suction holes 26.

The shroud 40 may be coupled to the discharge panel 56. The shroud 40 and the discharge panel 56 may define a fan housing that surrounds the fan motor unit 60. The shroud 40 may define the heat exchange chamber 24 along with the inner case 14 to which the fan assembly 10 is installed. The heat exchange chamber 24 may be defined between the front surface of a rear plate of the inner case 14 and the rear surface of a rear plate of the fan assembly 10. The heat exchange chamber 24 may extend a long length in the vertical direction. The lower region of the heat exchange chamber may communicate with the freezing compartment 2 through the heat exchange chamber suction holes 26, and the upper region of the heat exchange chamber may communicate with the fan assembly 10 through the suction hole 38.

The shroud 40 may include a rear plate 41 formed with the suction hole 38, and a left plate 42, a right plate 43, and an upper plate 44, which are formed at the rear plate 41.

At least one of the shroud 40 and the discharge panel 56 may be provided with a housing portion 45, which is configured to guide the air having passed through the suction hole 38. The housing portion 45 may be located in a space S defined by the shroud 40 and the discharge panel 56. The housing portion may protrude forward from the shroud 40 toward the discharge panel 56, or may protrude rearward from the discharge panel 56 toward the shroud 40. The housing portion 45 may be configured as a curved portion, or may be configured so as to combine a curved portion and a flat portion. The housing portion 45 may be formed at a position spaced apart from the periphery of a fan 66 that will be described below. The housing portion 45 may be shaped to surround the entire periphery of the fan 66, or may be shaped to surround a portion of the periphery of the fan 66.

The shroud 40 may have an opening 46 formed in one of the left plate 42 and the right plate 43. The shroud 40 may further have a flow path guide 47 formed at the rear plate 41 so as to protrude toward the discharge panel 12, the flow path guide serving to guide the air to the opening 46. The flow path guide 47 may be formed to guide the air, blown to the periphery of the fan 66, to the opening 46. The flow path guide 47 may be inclined toward the opening 46. The cold air discharge duct 32 may enable communication between the opening 46 and the refrigerating compartment 4, and the air discharged through the opening 46 may flow to the refrigerating compartment 4 through the cold air discharge duct 32.

The shroud 40 may include a receiving portion 48 formed at an upper portion thereof, the receiving portion being stepped to protrude rearward such that the fan motor unit 60 is received inside the receiving portion. The receiving portion 48 may be located at the upper side of the evaporator 8 so as to be spaced apart from the evaporator 8 by a certain height. The receiving portion 48 of the shroud 40 may be defined by the rear plate 41, the left plate 42, the right plate 43, the upper plate 44, and a lower plate 50. The receiving portion 48 may take the form of a box having an open front side. The housing portion 45 may be formed at the receiving portion 48. The opening 46 may be formed in the receiving portion 48. The flow path guide 47 may be formed at the receiving portion 48.

The shroud 40 may include an evaporator flow path guide portion 49 to guide the air flowing in the storage compartment 2 to the evaporator 8. The evaporator flow path guide portion 49 may be located at the front side of the evaporator 8. The receiving portion 48 may be located at the upper side of the evaporator flow path guide portion 49.

The shroud 40 may be provided on a surface 41' thereof that faces the discharge panel 56 with a fan motor unit mount 52, to which the fan motor unit 60 is installed. The fan motor unit mount 52 will be described below in detail.

The discharge panel 56 may cause the air, blown by the fan motor unit 60, to be discharged to the storage compartment 2. The discharge panel 56 may be provided with at least one discharge hole 28. A plurality of discharge holes 28 may be formed so as to be spaced apart from one another. The discharge panel 56 may be disposed to cover the front surface of the shroud 40, and may define a space S along with the shroud 40 for guiding the discharge of air. The space S defined by the shroud 40 and the discharge panel 56 may extend a long length in the vertical direction. The discharge panel 56 may define the external appearance of the front surface of the fan assembly 10, and may be visible from the outside when the freezing compartment 2 is opened. The discharge panel 56 may define, along with the inner case 12 to which the fan assembly 10 is installed, the storage compartment, i.e. the freezing compartment 2.

The fan motor unit 60 may be located at a position between the shroud 40 and the discharge panel 56 so as to flow the air. The fan motor unit 60 may be installed to the shroud 40 so as to suction the air through the suction hole 38 and then to discharge the air through the opening 46 and the discharge holes 28. The fan motor unit 60 may include a motor bracket 62 fastened to the fan motor unit mount 52, a motor 64 installed to the motor bracket 62, the motor having a rotating shaft 63 protruding therefrom, and a fan 66 installed to the rotating shaft 63.

The motor bracket 62 may include a motor coupling portion 68 coupled to the motor 64, and at least one support leg 69 protruding from the motor coupling portion. The support leg 69 of the motor bracket 62 may be coupled to the fan motor unit mount 52. The support leg 69 may be coupled to the fan motor unit mount 52 using a fastening member 69' such as, for example, a screw.

The rotating shaft 63 of the motor 64 may protrude toward the suction hole 38. The motor 64 may be located at the front side of the suction hole 38. The rotating shaft 63 may protrude rearward from the motor 64. The motor 64 may be located between the suction hole 38 and the discharge panel 56. When the motor 64 is located between the suction hole 38 and the discharge panel 56, a separate space for the installation of the motor 64 is not necessary between the suction hole 38 and the inner case 14, which may increase the volume of the freezing compartment 2 of the refrigerator.

The fan 66 is a blower that is rotated to flow the air when the motor 64 is driven. The fan 66 may be rotated between the shroud 40 and the discharge panel 56. As such, the fan 66 may be protected by the shroud 40 and the discharge panel 56. The fan 66 may be configured as a turbo fan which suctions air from the rear side and blows the air in the radial direction. When the fan 66 is rotated, the air present at the rear side of the suction hole 38 may be suctioned forward to the fan 66, and may then be blown in the radial direction of the fan 66 by the rotation of the fan 66.

In the refrigerator, unlike the illustration of FIG. 2, when the fan motor unit mount 52 protrudes rearward from the shroud 40, the fan motor unit 60 may be installed to the rear surface of the shroud 40 and may blow the air to the suction hole 38 while being located at the rear side of the suction hole 38. In this case, the suction hole 38 may serve as a discharge flow path on the basis of the fan motor unit 60. When the fan motor unit 60 is located before the suction hole 38 in the direction in which the air flows, the motor bracket 62 and the motor 64, which constitute the fan motor unit 60, may resist the suction of air into the suction hole 38.

On the other hand, when the fan motor unit mount 52 protrudes forward from the shroud 40 as illustrated in FIG. 2, the fan motor unit 60 may suction the air through the suction hole 38 while being located at the front side of the suction hole 38. In this case, the suction hole 38 may serve as a suction flow path on the basis of the fan motor unit 60. When the fan motor unit 60 is located after the suction hole 38 in the direction in which the air flows, the motor bracket 62 and the motor 64 of the fan motor unit 60 do not resist the suction of air through the suction hole 38. That is, when the fan motor unit mount 52 protrudes forward from the shroud 40, the flow path resistance may be reduced compared to the case where the fan motor unit mount 52 protrudes rearward from the shroud 40, which enables a reduction in the number of revolutions per minute of the fan 66 while maintaining the same flow rate, and a reduction in power consumption and noise.

The fan motor unit mount 52 may protrude from the shroud 40 toward the discharge panel 56. The fan motor unit mount 52 may be formed at the receiving portion 48. The fan motor unit mount 52 may be spaced apart from a periphery 67 of the fan 66 in the radial direction of the fan 66. The fan motor unit mount 52 may be formed at at least one position between the suction hole 38 and the housing portion 45. The fan motor unit mount 52 may be formed at at least one position between the suction hole 38 and the flow path guide 47. The fan motor unit mount 52 may have a tip end 52' spaced apart from a rear surface 57 of the discharge panel 56 in the front-and-rear direction. A distance T1 between the fan motor unit mount 52 and the rear surface 57 of the discharge panel 56 may be longer than a thickness T2 of the motor bracket 62.

The fan motor unit mount 52 may include at least one boss 71, 72, 73 and 74 formed at the shroud 40. A plurality of bosses 71, 72, 73 and 74 may be formed at the shroud 40. The bosses 71, 72, 73 and 74 may be formed at the shroud 40 so as to be spaced apart from one another. The bosses 71, 72, 73 and 74 may protrude from the front surface 41' of the rear plate 41 toward the discharge panel 50. A virtual circle C, which connects the bosses 71, 72, 73 and 74 to one another, may be larger than the fan 66. A center axis X1 of the virtual circle C connecting the bosses 71, 72, 73 and 74 to one another may coincide with a center axis X2 of the suction hole 38. The bosses 71, 72, 73 and 74 may be formed such that the first boss 71 is located between the suction hole 38 and the housing portion 46. The bosses 71, 72, 73 and 74 may be formed such that the second boss 72 is located between the suction hole 38 and the flow path guide 47. The bosses 71, 72, 73 and 74 may be formed such that the third boss 73 is located between the suction hole 38 and the left plate 42. The bosses 71, 72, 73 and 74 may be formed such that the fourth boss 74 is located between the suction hole 38 and the right plate 43.

Hereinafter, the operation of assembling the shroud 40 and the fan motor unit 60 will be described.

First, the fan 66 may be installed to the rotating shaft 63 of the motor 64, and the assembly of the fan 66 and the motor 64 may be completed as the motor 64 is fastened to the motor bracket 66 using a fastening member such as, for example, a screw. The fan motor unit 60 may be fastened to the shroud 40 in the state in which the fan 66 is installed to the motor 64 and the motor 64 is installed to the motor bracket 66.

A worker may first position the support leg 69 of the motor bracket 66 at the front end of the fan motor unit mount 52 in the front-and-rear direction, and thereafter may fasten the support leg 69 of the motor bracket 66 to the fan motor unit mount 52 using a fastening member such as, for example, a screw.

Once the motor bracket 66 has been fastened to the fan motor unit mount 52 as described above, the center axis of the fan 66 and the center axis X2 of the suction hole 38 may coincide with each other in the front-and-rear direction.

When the fan motor unit 60 is fastened to the discharge panel 56 and the shroud 40 is fastened to the discharge panel 56, the center axis of the fan 66 and the center axis X2 of the suction hole 38 may not coincide with each other due to, for example, assembly tolerance. However, when the fan motor unit 60 is directly fastened to the shroud 40, the center axis of the fan 66 and the center axis X2 of the suction hole 38 are likely to coincide with each other, which may minimize additional work for the maintenance of the concentric arrangement.

Hereinafter, the operation of the refrigerator having the above-described configuration will be described.

First, when the motor 64 is driven, the fan 66 may be rotated between the shroud 40 and the discharge panel 56. Suction force may be generated near the suction hole 38 by rotation of the fan 66, thus causing the air present at the rear side of the shroud 40 to be suctioned into the suction hole 38. Since the air is suctioned into the suction hole 38 and the motor 64 is located at the front side of the suction hole 38, flow path resistance and noise of the air may be minimized, and the air may be rapidly suctioned through the suction hole 38. The air having passed through the suction hole 38 may be blown by the fan 66 in the radial direction of the fan 66. Thereafter, the air may be blown between the shroud 40 and the discharge panel 56. Some of the air blown to the shroud 40 and the discharge panel 56 may be supplied to the freezing compartment 2 through the discharge holes 28, and the remaining air may be supplied to the refrigerating compartment 4 through the opening 46 and the cold air discharge duct 32.

The air supplied to the freezing compartment 2 may cool, for example, the food received in the freezing compartment 2, and thereafter may be suctioned into the heat exchange chamber 24 through the suction holes 26.

Meanwhile, the air supplied to the refrigerating compartment 4 may cool, for example, the food received in the refrigerating compartment 4, and thereafter may be suctioned into the heat exchange chamber 24 through the cold air suction duct 30.

The air, suctioned into the heat exchange chamber 24, may be guided to the evaporator 8 by the shroud 40, and thereafter may be cooled via heat exchange with the refrigerant passing through the evaporator 8. The air cooled by the evaporator 8 may flow upward, and may then again be suctioned into the suction hole 38.

The invention claimed is:

1. A refrigerator comprising:

an evaporator;

a shroud formed with a suction hole for suction of air having undergone heat exchange with the evaporator;

a fan motor unit installed to the shroud;

a discharge panel formed with a discharge hole for discharge of the air, blown by the fan motor unit, to a storage compartment; and a door configured to open or close the storage compartment, wherein the shroud is formed, on a surface thereof facing the discharge panel, with a fan motor unit mount for installation of the fan motor unit, wherein the fan motor unit is located at a position between the shroud and the discharge panel so as to flow the air, and wherein the fan motor unit mount has a tip end spaced apart from a rear surface of the discharge panel in a front-and-rear direction to define a space between the fan motor unit and the discharge panel in the front-and-rear direction.

2. The refrigerator according to claim 1, wherein at least one of the shroud and the discharge panel is formed with a housing portion, the housing portion being configured to guide the air having passed through the suction hole, and wherein the fan motor unit mount is formed at least one position between the suction hole and the housing portion.

3. The refrigerator according to claim 1, wherein the fan motor unit includes:

a motor bracket fastened to the fan motor unit mount;

a motor installed to the motor bracket so as to be located between the shroud and the discharge panel, the motor having a rotating shaft configured to protrude toward the suction hole; and a fan installed to the rotating shaft, the fan being rotated between the shroud and the discharge panel.

4. The refrigerator according to claim 3, wherein the fan is a turbo fan configured to suction air from the rear side and to blow the air in a radial direction.

5. The refrigerator according to claim 1, wherein the fan motor unit mount protrudes from the shroud to the discharge panel, and is spaced apart from a periphery of the fan in a radial direction of the fan.

6. The refrigerator according to claim 5, wherein the fan motor unit mount includes a plurality of bosses protruding from the shroud so as to be spaced apart from the shroud, and wherein a virtual circle connecting the bosses to one another is larger than the fan.

7. The refrigerator according to claim 1, wherein the fan motor unit mount includes a plurality of bosses protruding from the shroud so as to be spaced apart from the shroud, and wherein a center axis of a virtual circle connecting the bosses to one another coincides with a center axis of the suction hole.

8. The refrigerator according to claim 1, wherein the shroud includes a rear plate formed with the suction hole, and a left plate, a right plate, and an upper plate formed at the rear plate, and wherein the fan motor unit mount includes a plurality of bosses formed at a front surface of the rear plate so as to protrude toward the discharge panel.

9. The refrigerator according to claim 1, wherein the shroud is provided at an upper portion with a receiving portion for reception of the fan motor unit, the receiving portion being stepped to protrude rearward, and wherein the fan motor unit mount is formed at the receiving portion.

10. The refrigerator according to claim 1, wherein the shroud includes an evaporator flow path guide portion located at the front side of the evaporator, the evaporator flow path guide being configured to guide air flowing from the storage compartment to the evaporator.

11. A refrigerator comprising:

an evaporator;

a shroud formed with a suction hole for suction of air having undergone heat exchange with the evaporator;

a fan motor unit installed to the shroud;

a discharge panel formed with a discharge hole for discharge of the air, blown by the fan motor unit, to a storage compartment; and a door configured to open or close the storage compartment, wherein the shroud is formed, on a surface thereof facing the discharge panel, with a fan motor unit mount for installation of the fan motor unit, wherein the fan motor unit is located at a position between the shroud and the discharge panel so as to flow the air, wherein the shroud has an opening formed in one of a left plate and a right plate, wherein the shroud has a rear plate formed with a flow path guide to guide air to the opening, the flow path guide protruding toward the discharge panel, and wherein the fan motor unit mount is formed at least one position between the suction hole and the flow path guide.

12. A refrigerator comprising:

a main body defining a freezing compartment, a refrigerating compartment, and a heat exchange chamber;

an evaporator installed in the heat exchange chamber;

a freezing compartment door configured to open or close the freezing compartment;

a refrigerating compartment door configured to open or close the refrigerating compartment;

a shroud formed with a suction hole for suction of air having undergone heat exchange with the evaporator and an opening;

a discharge panel formed with a discharge hole for discharge of cold air to the freezing compartment;

a fan motor unit installed to the shroud, the fan motor unit being configured to suction air into the suction hole and to discharge the air through the opening and the discharge hole;

a cold air discharge duct configured to communicate the opening and the refrigerating compartment with each other; and a cold air suction duct configured to communicate the refrigerating compartment and the heat exchange chamber with each other, wherein the shroud is formed, on a surface thereof facing the discharge panel, with a fan motor unit mount for installation of the fan motor unit, wherein the fan motor unit is located at a position between the shroud and the discharge panel so as to flow the air, wherein the fan motor unit mount includes a plurality of bosses protruding from the shroud so as to be spaced apart from the shroud, and wherein a virtual circle connecting the bosses to one another is larger than the fan.

13. The refrigerator according to claim 12, wherein the fan motor unit includes:

a motor bracket fastened to the fan motor unit mount;

a motor installed to the motor bracket so as to be located between the shroud and the discharge panel, the motor having a rotating shaft configured to protrude toward the suction hole; and a fan installed to the rotating shaft, the fan being rotated between the shroud and the discharge panel.

14. The refrigerator according to claim 12, wherein the fan is a turbo fan configured to suction air from the rear side and to blow the air in a radial direction.

15. The refrigerator according to claim 12, wherein the fan motor unit mount protrudes from the shroud to the discharge panel, and is spaced apart from a periphery of the fan in a radial direction of the fan.

16. The refrigerator according to claim 12, wherein at least one of the shroud and the discharge panel is configured to separate the freezing compartment and the heat exchange chamber from each other.

17. The refrigerator according to claim 12, wherein at least one of the shroud and the discharge panel is configured to guide, air, introduced into the heat exchange chamber, to the evaporator.

18. The refrigerator according to claim 12, wherein the shroud is provided at an upper portion with a receiving portion for reception of the fan motor unit, the receiving portion being stepped to protrude rearward, and wherein the fan motor unit mount is formed at the receiving portion.

* * * * *